US007314138B2

(12) United States Patent
McEvoy-Sherman

(10) Patent No.: US 7,314,138 B2
(45) Date of Patent: Jan. 1, 2008

(54) COSMETIC PLANNER DEVICE AND INSERT STRIP

(75) Inventor: Patricia McEvoy-Sherman, New York, NY (US)

(73) Assignee: Trish McEvoy, Ltd., New York, NY (US)

( * ) Notice: Subject to any disclaimer, the term of this patent is extended or adjusted under 35 U.S.C. 154(b) by 276 days.

(21) Appl. No.: 11/009,177

(22) Filed: Dec. 10, 2004

(65) Prior Publication Data

US 2006/0124150 A1 Jun. 15, 2006

(51) Int. Cl.
*B65D 73/00* (2006.01)
*B42F 3/00* (2006.01)
*B42F 13/00* (2006.01)

(52) U.S. Cl. ..... 206/581; 206/472; 206/823; 402/4; 402/79

(58) Field of Classification Search ..... 206/581, 206/235, 472–475, 823; D28/76–77; 402/4, 402/75, 79–80 R, 500, 502
See application file for complete search history.

(56) References Cited

U.S. PATENT DOCUMENTS

| | | | | | |
|---|---|---|---|---|---|
| 5,409,319 | A | * | 4/1995 | Bedol | 402/4 |
| 5,476,336 | A | * | 12/1995 | Osiecki et al. | 402/79 |
| 5,584,387 | A | * | 12/1996 | Grant | 402/79 |
| 5,785,446 | A | * | 7/1998 | Dlugos | 402/79 |
| D400,702 | S | | 11/1998 | McEvoy Sherman | |
| 5,876,144 | A | * | 3/1999 | Bedol et al. | 402/4 |
| D408,130 | S | | 4/1999 | Sherman | |
| D411,345 | S | | 6/1999 | McEvoy Sherman | |
| 6,004,060 | A | * | 12/1999 | Bedol | 402/4 |
| 6,155,738 | A | * | 12/2000 | King | 402/79 |
| 6,164,451 | A | | 12/2000 | Sherman | |
| D482,162 | S | * | 11/2003 | Bostroem | D28/77 |
| 6,766,907 | B2 | * | 7/2004 | Jackson | 206/581 |

* cited by examiner

*Primary Examiner*—Bryon P. Gehman
(74) *Attorney, Agent, or Firm*—Buckley, Maschoff & Talwalkar LLC

(57) ABSTRACT

A cosmetics planner insert, in some embodiments, includes a cosmetics device and an insert strip having a connector side and a binder side. The connector side is for connecting the insert strip to the cosmetics device, and the binder side is for removably inserting the cosmetics planner insert into a cosmetics planner. In some embodiments, the connector side removably connects the insert strip to the cosmetics device. In some embodiments, the connector side hingedly connects the insert strip to the cosmetics device.

15 Claims, 7 Drawing Sheets

COSMETIC PLANNER DEVICE AND INSERT STRIP

FIELD

The present invention relates to cosmetics. More particularly, embodiments relate to inserts for cosmetic planners.

BACKGROUND

Cosmetic or make-up planners were first introduced by the assignee of the present application several years ago. For example, one version of a cosmetic planner is described in U.S. Pat. Ser. No. 6,164,451, commonly owned by the assignee of the present application. These planners provide users with an organized, convenient, and customizable way to carry and access cosmetics. Some planners, for example, are configured as closeable ring binders with one or more planner inserts or pages held by the binder rings. For example, as shown in the '451 patent, a planner insert may be a sheet insert which has a number of holes corresponding to the binder rings of the planner. Each planner insert, accordingly, can be easily installed or removed from the planner, allowing a user to customize the planner with a desired cosmetic selection. Other planner inserts are shown in U.S. Pat. Ser. Nos. D408,130 and D411,345, also owned by the assignee of the present application. The contents of each of the above-referenced patents are incorporated herein by reference for all purposes.

Unfortunately, planner inserts are generally not suited for other uses, as each insert has a lip or protrusion where the binder holes are located. This lip can make it difficult or awkward to carry a planner insert in, for example, a pocket or purse. It would be desirable to provide improved inserts without a lip that can readily be used with or without a planner.

SUMMARY

To alleviate these and other problems associated with previous devices, embodiments of the present invention introduce an improved cosmetics planner insert. Pursuant to some embodiments, a cosmetics planner insert includes a cosmetics device and an insert strip, the insert strip having a connector side and a binder side, the connector side connected to the cosmetics device and the binder side formed to removably attach to a cosmetics planner.

In some embodiments, the cosmetics device is a compact, mirror, planner insert page, or other item suitable for use in a cosmetics planner. In some embodiments, the cosmetics device is removably connected to the insert strip using one or more male to female connectors. In some embodiments, the cosmetics device is hingedly connected to the insert strip, and the cosmetics device may be attached to a cosmetics planner when the insert strip is placed in an open position and may be used outside of a cosmetics planner when the insert strip is placed in a closed position.

DETAILED DESCRIPTION

The following description is provided to enable a person of ordinary skill in the art to make and use embodiments of the claimed invention and sets forth the best modes contemplated by the inventor for carrying out the claimed invention. Various modifications, however, will remain readily apparent to those in the art.

Figure 1:
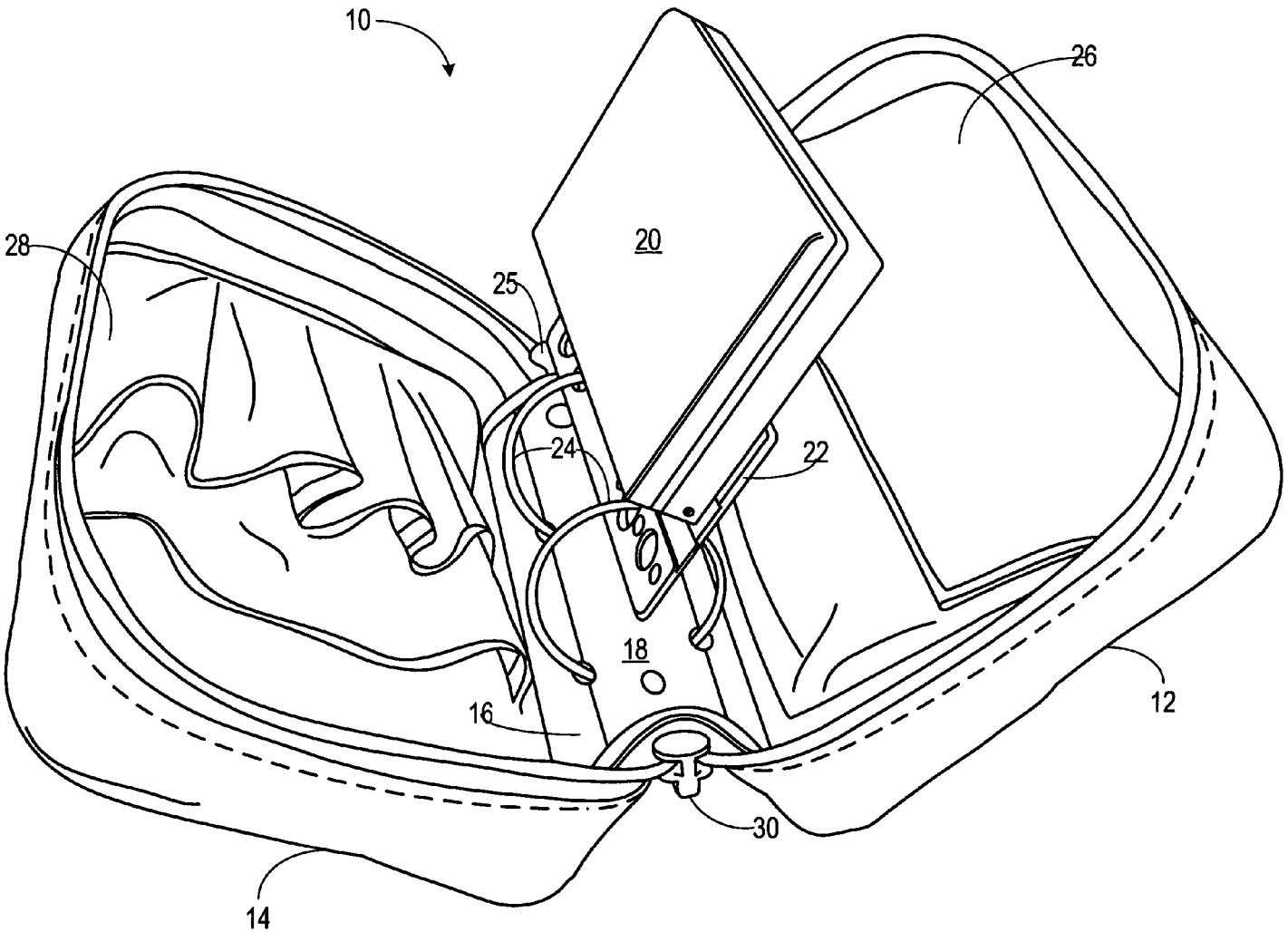
FIG. 1 is a perspective view of a cosmetics case with an insert device pursuant to some embodiments.

Embodiments of the present invention relate to cosmetic products and more particularly to improved inserts for use with make-up planners or cosmetic cases. Features of some embodiments will now be described by reference to the drawings. Referring first to FIG. 1, a perspective view of a planner 10 is shown. In the embodiment shown in FIG. 1, planner 10 is a binder-style cosmetics planner having a front cover 12 and a back cover 14 connected by a connecting member 16. Connecting member 16 supports a binder spine 18 having one or more binder rings 24.

In some embodiments, binder spine 18 is configured using techniques known to those skilled in the art, allowing binder rings 24 to be selectively opened and closed (e.g., by manipulating a binder latch 25) to allow the insertion and removal of one or more binder inserts such as the binder insert 20. As shown, a recess defined by the front cover 12 may be used to hold a front cover insert 26 (e.g., such as a pocket, bag, or other container). Similarly, a recess defined by the back cover 14 may be used to hold a back cover insert 28. Any of a number of different types of inserts may be used, including mesh bags, pockets, holders, or other devices adapted to organize or hold items for carrying within planner 10.

Binder insert 20 may be any of a number of different types of inserts. In the depicted embodiment, binder insert 20 is a compact. Further details of some embodiments of a compact will be provided below in conjunction with FIG. 2. Other types of inserts may also be used. For example, binder insert 20 may be a make-up holder sheet such as one of the sheets shown in the above-referenced U.S. Pat. No. 6,164,451. Binder insert 20 may also be a mirror, make-up applicator, or other item that is suitable for carrying in planner 10.

Pursuant to some embodiments, binder insert 20 is detachably mounted to a connecting strip 22 for mounting on binder rings 24 of planner 10. For example, pursuant to some embodiments, connecting strip 22 may snap or otherwise detachably mount to a bottom portion of binder insert 20 such as a compact or other item. In this manner, a user of planner 10 may easily remove binder insert 20 and carry the binder insert 20 separately from planner 10. As an example, a user may unsnap a compact from the connecting strip of her planner so that she can carry the compact on its own. As another example, a user may easily snap a new or replacement compact onto the connecting strip of her planner. As a further example, a user may customize her planner (e.g., for a vacation or trip) by selecting from a variety of binder inserts and snapping the desired binder inserts into a planner. Although only a single binder insert 20 and a single connecting strip 22 are shown in FIG. 1, those skilled in the art will appreciate that a number of each may be used in planner 10.

Pursuant to some embodiments, each binder insert 20 may be formed to detachably and interchangeably mount on connecting strip 22. If desired, the user can leave one or more connecting strips 22 in the binder and attached to the binder rings 24, allowing the user to attach binder inserts as desired. Some binder inserts 20 may be constructed so that they can be easily carried and used outside of the planner 10. For example, the compact shown in FIG. 1 is easily carried in a purse or pocket when removed from planner 10. That is, pursuant to some embodiments, a binder insert 20 can easily be attached to a connecting strip 22 for use in a planner 10, and can easily be removed from the connecting strip 22 for use outside of the planner, without any protruding or interfering connecting strip.

Planner 10, as shown, may be closed using a zipper or other closing device 30. Those skilled in the art will recognize that planner 10 may be closed or secured in any of a number of different ways, including, for example: snaps, Velcro®, ties, latches, or the like. Planner 10, binder insert 20, and connecting strip 22 may be formed of a number of different types of materials, including, for example, fabric, plastic, composites, metal, or the like. In one specific embodiment, planner 10 is formed from fabric and plastic, and binder insert 20 and connecting strip 22 are formed of molded plastic.

Figure 2:
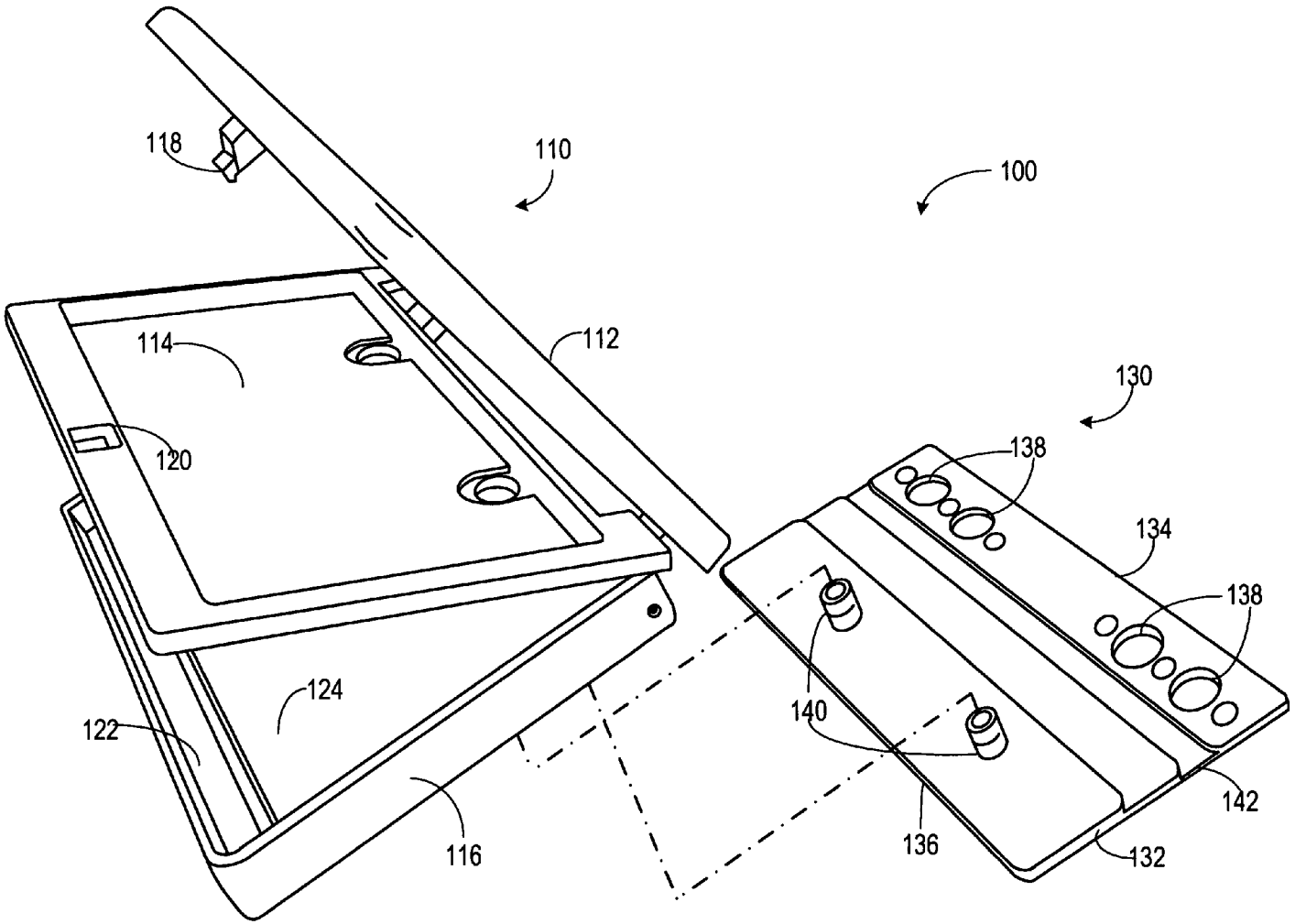
FIG. 2 is a perspective view of an insert device pursuant to some embodiments.

Reference is now made to FIG. 2, where a perspective view of an insert system 100 is shown. Insert system 100 includes a binder insert 110 removably coupled to a separate connecting strip 130. Binder insert 110, as depicted, is a compact that includes a top portion 112, a center portion 114, and a bottom portion 116 each hingedly connected to allow the compact to be opened. In some embodiments, a locking mechanism 118 is provided to securely close the compact (e.g., in one embodiment, by extending through an aperture 120 and latching to a lip 122). Binder insert 110 may hold cosmetics in a tray formed on center portion 114 and in a tray 124 formed in bottom portion 116. One or more mirrors (not shown) may also be provided (e.g., attached to a bottom surface of top portion 112 or the like). Pursuant to some embodiments, binder insert 110 is formed to be useful both when inserted into a planner and when carried separately.

Connecting strip 130, in some embodiments, includes a strip body 132 defining an area having a binder side 134 and a connector side 136 separated by a flange area 142. In one embodiment, strip body 132 is formed from molded plastic or the like. In some embodiments, binder side 134 includes one or more apertures 138 spaced and sized to allow connecting strip 130 to be placed in a binder (e.g., by fitting on one or more binder rings). In some embodiments, binder side 134 includes multiple apertures 138 allowing connecting strip 130 to be inserted into different sized binders. For example, binder side 134 may include apertures 138 spaced to allow connecting strip 130 to fit in both a two-ring and a four-ring planner.

Flange 142 is provided in some embodiments to separate connector side 136 from binder side 134 and provides sufficient clearance so that binder insert 110 to be opened and manipulated while attached to connecting strip 130 and inserted into a planner.

Connector side 136 includes one or more connecting devices 140 formed to securely and removably attach connecting strip 130 to binder insert 110. In the depicted embodiment, two protruding connecting devices 140 are provided to mate with two corresponding connectors formed in bottom portion 116 of binder insert 110. Those skilled in the art, upon reading this disclosure, will recognize that other shapes and configurations of connecting devices 140 may be used (including, for example, the connecting devices shown and described in conjunction with FIGS. 5-7, below).

Pursuant to some embodiments, binder inserts and connecting strips are formed to be interchangeable. For example, connecting strip 130 is formed to removably attach to a variety of different binder inserts.

Figure 3:
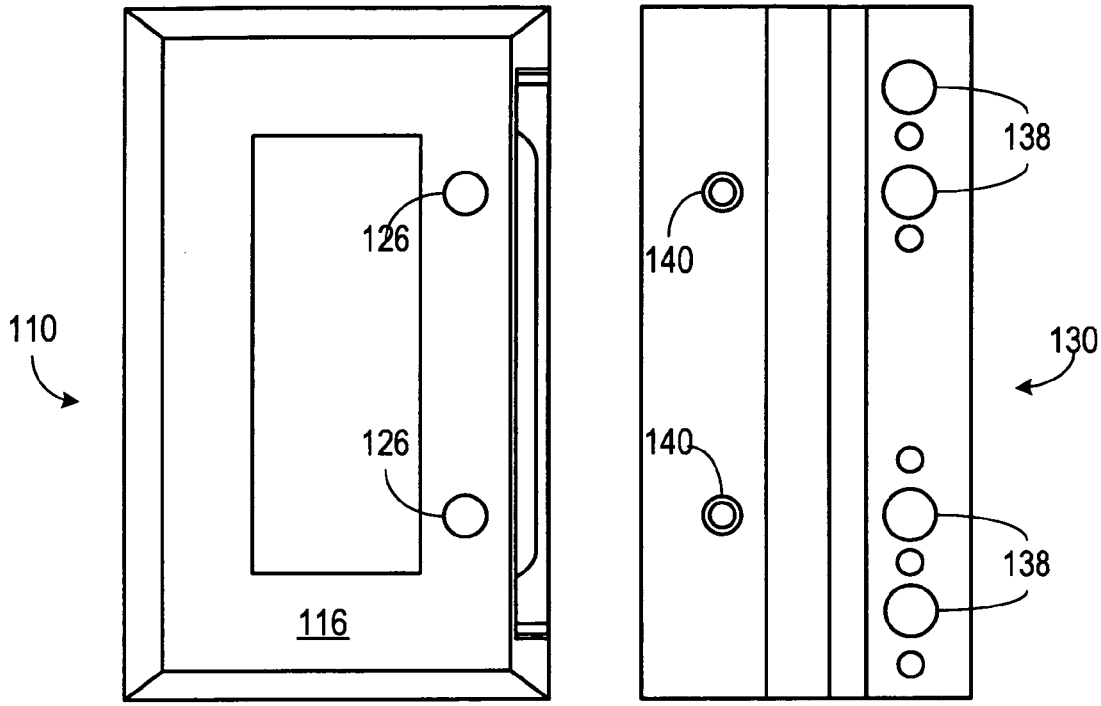
FIG. 3 is a top view of an insert device pursuant to some embodiments.

Referring now to FIG. 3, a view of binder insert 110 and connecting strip 130 is shown. As shown, binder insert 110 is formed with connecting devices 126 in bottom portion 116. Connecting devices 126 are shaped and sized to mate with the corresponding connecting devices 140 formed on connecting strip 130. In the depicted embodiment, connecting devices 140 securely mate within the connecting devices 126 of binder insert 110. Binder insert 110 is removed from connecting strip 130 by unplugging the connecting devices 140 from connecting devices 126.

Figure 4:
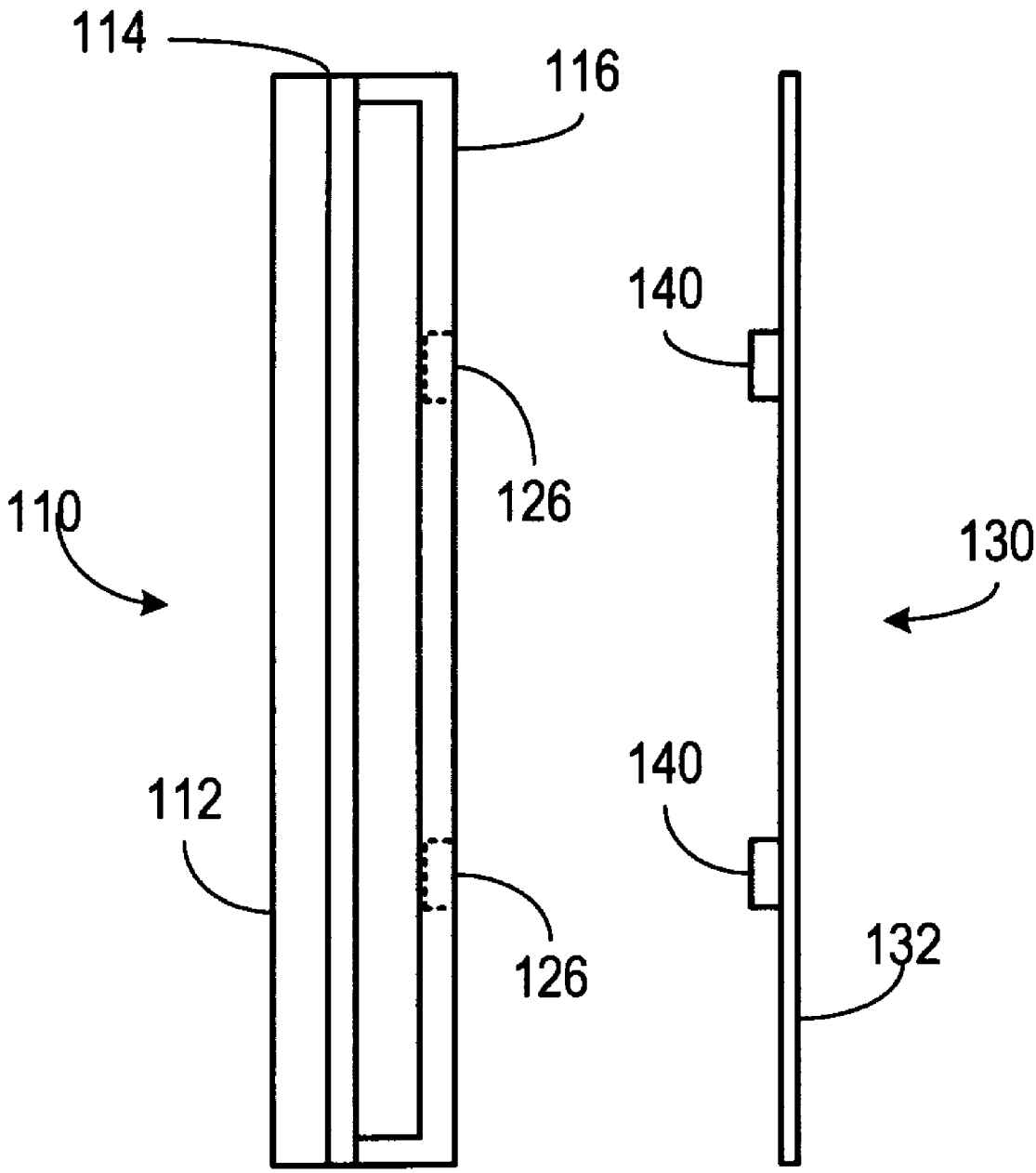
FIG. 4 is a side view of the insert device of FIG. 3.

Referring now to FIG. 4, a further view of binder insert 110 and connecting strip are shown, again illustrating the relationship between the connecting devices 140 of connecting strip 130 and the connecting devices 126 of binder insert 110.

Figure 5:
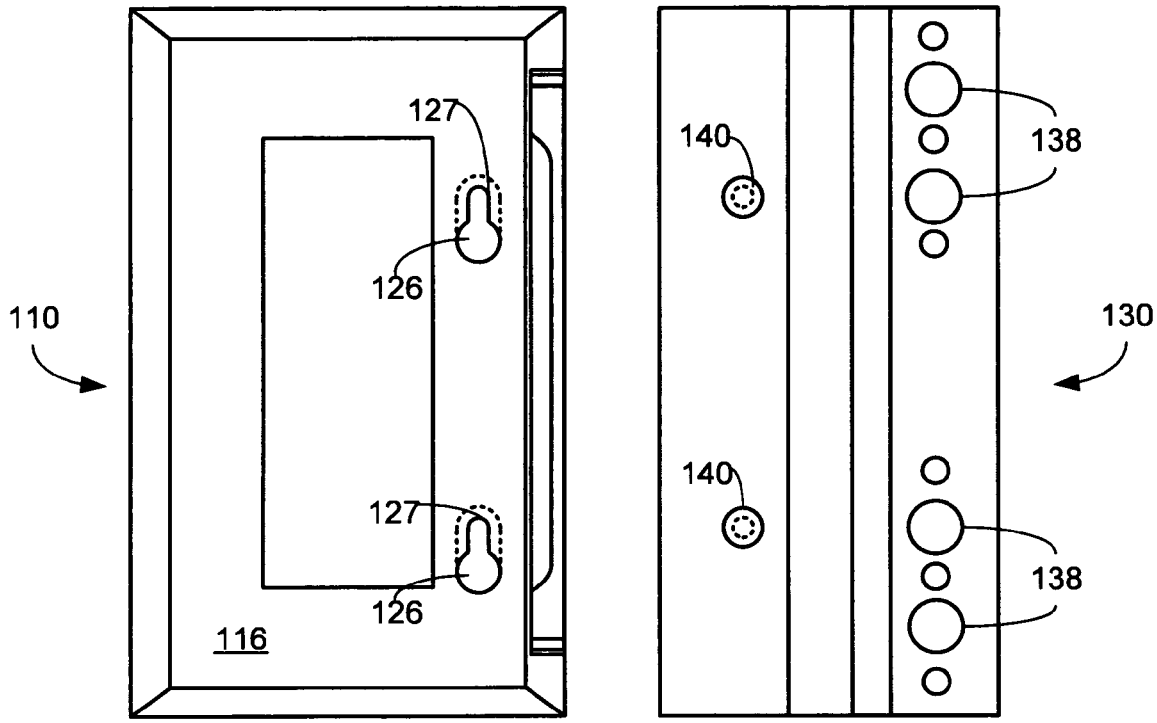
FIG. 5 is a top view of a further embodiment of an insert device pursuant to some embodiments.
Figure 6:
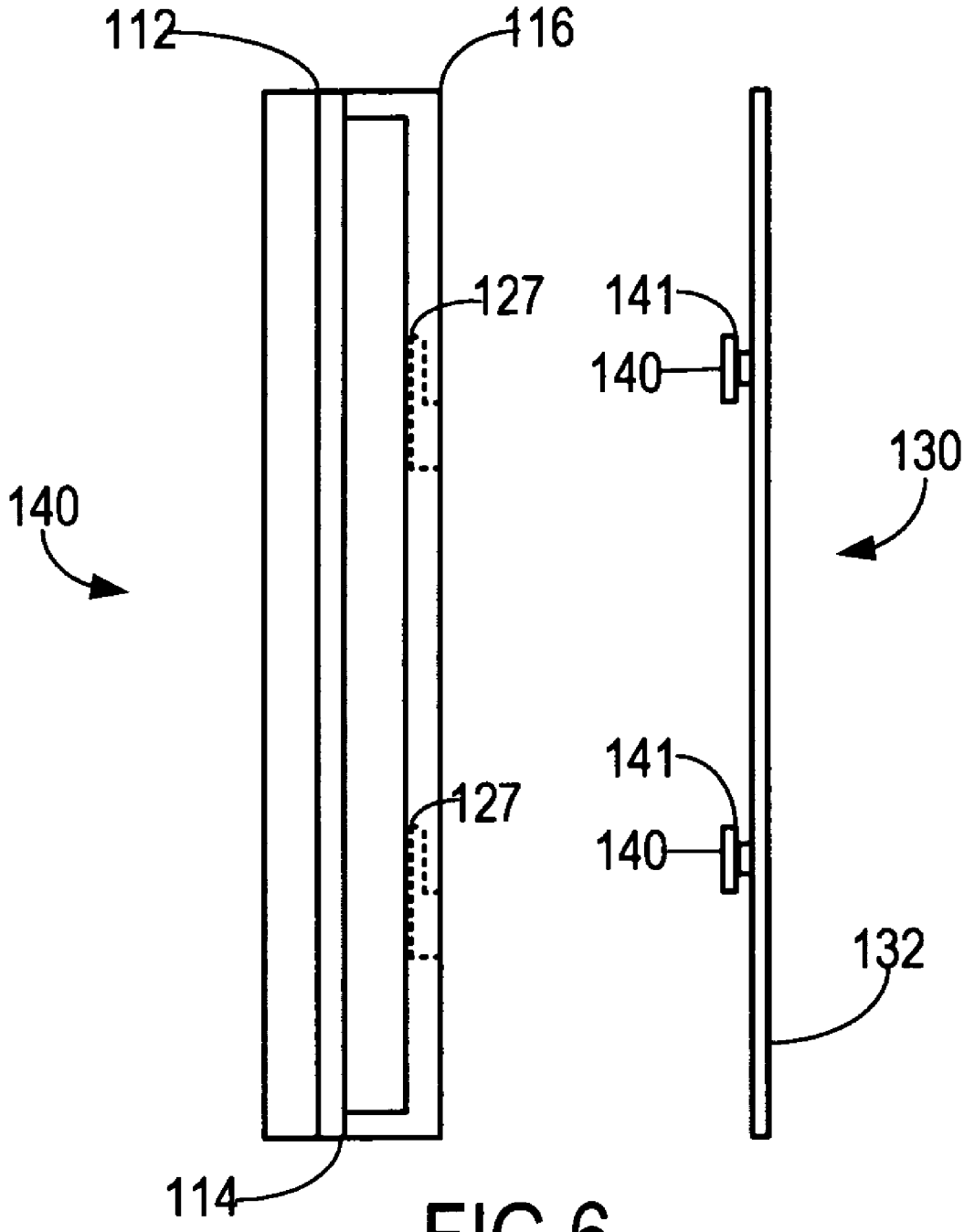
FIG. 6 is a side view of the insert device of FIG. 5.

Referring now to FIGS. 5 and 6, a further embodiment of a binder insert 110 is shown having a different configuration of connecting devices. As shown, connecting device 140 of connecting strip 130 are formed with a head portion 141 configured to mate within an insert portion 127 of connecting device 126 of binder insert 110. Binder insert 110 is attached to connecting strip 130 by inserting connecting device 140 into connecting device 126 and sliding head portion 141 into insert portion 127. Those skilled in the art will appreciate that other configurations of connectors may also be provided.

Figure 7:
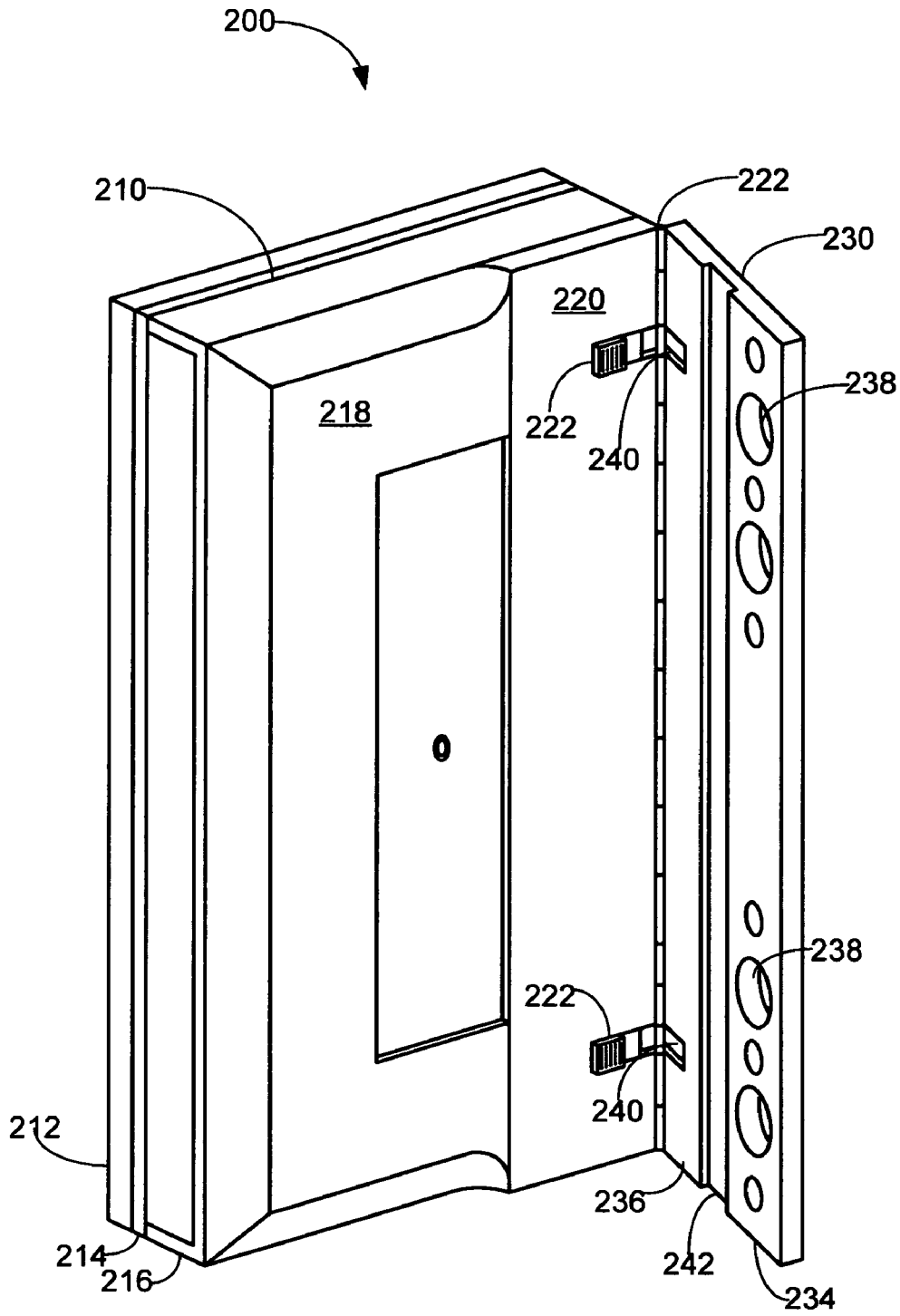
FIG. 7 is a perspective view of a further embodiment of an insert device pursuant to some embodiments.

Referring now to FIG. 7, a further embodiment of a binder insert system 200 is shown. In some embodiments, including the depicted embodiment, binder insert system 200 may include a binder insert 210 attached to a connector portion 230. For example, in some embodiments, binder insert 210 is attached to connector portion 230 via one or more hinges 222, allowing connector portion 230 to be placed in either an extended or a closed position. In the extended position, connector portion 230 is extended from the body of binder insert 210 and one or more apertures 138 are exposed, allowing the binder insert system 200 to be installed in a planner such as the planner 10 of FIG. 1. In some embodiments, connector portion 230 is held in the extended position by one or slide latches 222 by sliding the latches along a track 240.

In the closed position, connector portion 230 is folded below the body of binder insert 210. In some embodiments, connector portion 230 may be securely held in the closed position by a magnetic strip, latch, Velcro®, or the like. In some embodiments, binder insert 210 is formed with a bottom edge 218. When connector portion 230 is in the closed position, the connector portion 230 and the bottom edge 218 form a relatively even or planar surface, allowing the binder insert 210 to be used outside of a planner. For example, as shown, binder insert 210 is a compact. When connector portion 230 is in the open position, the compact may be securely and easily inserted into and used with a planner such as planner 10 of FIG. 1. When connector portion 230 is in the closed position, the compact may be readily and stylishly used outside of the planner without a lip or protrusion formed by the connector portion.

The several embodiments described herein are solely for the purpose of illustration. Embodiments may include any currently or hereafter-known versions of the elements described herein. Further, although the embodiments are briefly described for clarity, those skilled in the art will understand how to make any changes, if necessary, to the above-described apparatus and methods to accommodate these and other embodiments and applications.

Those skilled in the art will appreciate that a number of modifications or variations may be used consistent with embodiments disclosed herein. For example, the binder spine of the planner may be located on the front or back cover of the planner. The binder spine may also be placed horizontally within the planner. Other types of binder arrangements may also be used. Further, while one example of a compact as a form of insert is described, other configurations of compacts may also be used (e.g., rather than having a top, center and bottom portion, a compact may have two portions, or may have more than three portions). Additionally, while several types of connectors are described, those skilled in the art will appreciate that other connectors may also be used so long as the insert may be used both in and out of a planner. For example, either the insert strip or the binder insert may be formed of metal or have a metal portion which is magnetically attached to the other device. Further, while several types of latching mechanisms are described, those skilled in the art will appreciate that other latching mechanisms may also be used.

What is claimed:

1. A cosmetics planner insert, comprising:

a cosmetics device; and an insert strip having a connector side and a binder side, said connector side for connecting said insert strip to said cosmetics device, said binder side for removably inserting said planner insert into a cosmetics planner, the insert strip having a flange area separating the binder side and the connector side, and the connector side is thicker than the flange area and the connector side is thicker than the binder side.

2. The cosmetics planner insert of claim 1, wherein said insert strip is formed separately from said cosmetics device.

3. The cosmetics planner insert of claim 1, wherein the cosmetics device is at least one of a compact, a cosmetics holder sheet, and a mirror.

4. The cosmetics planner insert of claim 3, wherein the compact has a top portion, a center portion, and a bottom portion, said center portion and said bottom portion each defining a cosmetics tray.

5. The cosmetics planner insert of claim 4, wherein said top portion has at least a first mirror mounted thereon.

6. The cosmetics planner insert of claim 1, wherein said insert strip is removably attached to said cosmetics device.

7. The cosmetics planner insert of claim 6, wherein said insert strip has at least a first connector formed to mate with at least a first aperture formed in said cosmetics device.

8. The cosmetics planner insert of claim 1, wherein said cosmetic device comprises a top portion, a center portion, and a bottom portion each hingedly connected.

9. The cosmetics planner insert of claim 1, wherein the binder side is thicker than the flange area.

10. A cosmetics device, comprising:

a body, said body having a base; and at least a first connector formed in said base, said at least first connector for attaching said body to an insert strip, said insert strip connecting said cosmetics device to a cosmetics planner and formed separately from said body, said insert strip having a flange area separating the binder side and the connector side, and the connector side is thicker than the flange area and the connector side is thicker than the binder side.

11. The cosmetics device of claim 10, wherein said at least first connector is a hinge.

12. The cosmetics device of claim 10, wherein said at least first connector is an aperture formed to receive a protrusion formed on said insert strip.

13. A cosmetics system, comprising:

a cosmetics device; and an insert strip having a connector side and a binder side, said connector side for connecting said insert strip to said cosmetics device, said binder side for detachably coupling said cosmetics device in a cosmetics planner, said insert strip formed separate from said cosmetics device, said insert strip having a flange area separating the binder side and the connector side, and the connector side is thicker than the flange area and the connector side is thicker than the binder side.

14. The cosmetics system of claim 13, further comprising:

said cosmetics planner.

15. The cosmetics system of claim 14, said cosmetics planner further comprising:

a front cover;

a back cover;

a connecting member connected between the front cover and the back cover; and a binder member situated on at least one of the connecting member, the front cover and the back cover, the binder member including at least one holder, the at least one holder detachably coupling said cosmetics device.

* * * * *